US006160523A

United States Patent [19]

Ho

[11] Patent Number: 6,160,523

[45] Date of Patent: Dec. 12, 2000

[54] CRANK QUADRIFILAR SLOT ANTENNA

[76] Inventor: Chien H. Ho, 8394 Entreken Way, San Diego, Calif. 92192

[21] Appl. No.: 09/263,892

[22] Filed: Mar. 5, 1999

Related U.S. Application Data

[63] Continuation-in-part of application No. 08/642,506, May 3, 1996, Pat. No. 5,955,997.

[51] Int. Cl.[7] ..... H01Q 13/10; H01Q 1/36

[52] U.S. Cl. ..... 343/770; 343/767; 343/895; 343/700 MS

[58] Field of Search ..... 343/767, 768, 343/770, 895, 700 MS; H01Q 13/10, 1/36

[56] References Cited

U.S. PATENT DOCUMENTS

| | | | |
|---|---|---|---|
| D. 363,488 | 10/1995 | Shumaker | D14/230 |
| 2,665,381 | 1/1954 | Smith et al. | 250/33 |
| 2,877,427 | 3/1959 | Butler | 333/9 |
| 4,012,744 | 3/1977 | Greiser | 343/895 |
| 4,203,070 | 5/1980 | Bowles et al. | 375/1 |
| 4,297,707 | 10/1981 | Brunner et al. | 343/725 |
| 4,451,830 | 5/1984 | Lucas et al. | 343/768 |
| 4,612,543 | 9/1986 | DeVries | 343/5 |
| 4,675,691 | 6/1987 | Moore | 343/908 |
| 4,843,403 | 6/1989 | Lalezari et al. | 343/767 |
| 5,068,670 | 11/1991 | Maoz | 343/767 |
| 5,200,757 | 4/1993 | Jairam | 343/786 |
| 5,216,430 | 6/1993 | Rahm et al. | 343/700 |
| 5,255,005 | 10/1993 | Terret et al. | 343/895 |
| 5,353,040 | 10/1994 | Yamada et al. | 343/895 |
| 5,427,032 | 6/1995 | Hiltz et al. | 102/336 |
| 5,754,143 | 5/1998 | Warnagiris et al. | 343/767 |
| 5,854,608 | 12/1998 | Leisten | 343/895 |
| 5,955,997 | 9/1999 | Ho et al. | 343/767 |
| 5,986,616 | 11/1999 | Edvardsson | 343/895 |
| 5,995,064 | 11/1999 | Yanagisawa et al. | 343/895 |

*Primary Examiner*—Tan Ho
*Assistant Examiner*—Hoang Nguyen
*Attorney, Agent, or Firm*—Shook, Hardy & Bacon L.L.P.

[57] ABSTRACT

A quadrifilar crank slot antenna for GPS receivers. The antenna has a cylindrical dielectric body covered with a conductive coating. Four crank shaped slots are formed in a helical pattern in the antenna and extend around one half of its circumference to provide a right hand circular polarization for receiving GPS signals. A microstrip feed system is provided and is arranged to create balanced currents along both sides of each slot so that the impedance transformation is not adversely affected.

20 Claims, 3 Drawing Sheets

CH1 $S_{11}$ 1 U FS ∟ 55.951Ω 3.082 Ω 311.36 pH 1.5754 GHz

Cor MARKER 1
Del 1.5754GHz

CENTER 1.5754 GHz SPAN .2000 GHz

CRANK QUADRIFILAR SLOT ANTENNA

CROSS REFERENCE TO RELATED APPLICATION

This application is a continuation in part of U.S. application Ser. No. 08/642,506, filed May 3, 1996, now U.S. Pat. No. 5,955,997.

FIELD OF THE INVENTION

This invention relates generally to antennas used for the receipt of GPS signals and more specifically to cylindrical slot antenna having crank slots and finding particular utility in GPS hand held receivers.

BACKGROUND OF THE INVENTION

In recent years, the Global Positioning System (GPS) has provided a significant advancement in satellite communications. Individuals engaged in outdoor activities are major users of the GPS system, and they typically make use of hand held receivers to provide positional information. The receiver that is required in order to efficiently utilize the GPS satellite signals includes an antenna that must provide a right hand circular polarization and a uniform pattern coverage over virtually all of the upper hemisphere. By providing a uniform amplitude response over a wide coverage region, the receiver is able to maintain a signal lock to the GPS satellites with a useful signal to noise ratio.

Slot antennas have been developed and used in GPS applications, largely in recognition of the characteristics that GPS antennas must exhibit in order to effectively use the GPS system to provide accurate positional data. A variety of slotted antennas have been proposed, including cylindrical slot antennas that are provided with helical slots. The prior antennas have included four slots and have generally been described as a quadrifilar slot antennas that have used micro strip feed systems. This type of antenna has been found to be generally satisfactory in many applications, and it is characterized by a number of positive attributes, including the ability to produce broad beam patterns, simple feeding and matching techniques, suitability for mass production, and a lightweight and compact construction. However, cylindrical slot antennas have suffered from relatively poor coverage near the horizon and from multi-path shortcomings.

SUMMARY OF THE INVENTION

Accordingly, it is evident that a need exists for a GPS antenna that is improved in its ability to track satellites at low angles of elevation and in its resistance to multi-path signals. It is the principal goal of the present invention to meet that need.

More particularly, it is an object of the invention to provide an antenna that is improved in its ability to handle low elevation signals and to oppose multi-path signals. Another and related object of the invention is to provide an antenna that exhibits good impedance matching, a good front/back ratio and a substantially full hemispherical relation pattern coverage while taking advantage of the benefits of slot antennas.

In accordance with the present invention, a resonant quadrifiler structure is provided by forming four helical crank shaped slots in a cylindrical antenna in order to provide improvements over the slotted antennas that have been used in the past, primarily with respect to improved tracking near the horizon and improved resistance to multi-path signals.

The body of the GPS antenna of the present invention is formed as a cylinder, preferably constructed from a dielectric laminate. The outer surface of the cylinder is coated with a conductive material that provides a ground for microstrip feed lines. Four helical crank slots are etched in the coating starting at one end of the cylinder and terminating well short of the opposite end. Each slot extends around approximately one-half of the circumference of the cylinder. Each slot has a crank configuration, including upper and lower legs and a center portion which includes lateral arms extending from the legs and a center leg extending between the outer ends of the arms.

The microstrip feed lines are connected with an electric circuit and include transverse portions that cross the lower legs of the slots at right angles. Longitudinal portions of the feed lines extend from the transverse portions and are parallel to and extend beyond the lower legs. The ends of the feed lines terminate in open circuits. The longitudinal portions have lengths that are equal to about one fourth wavelength of the GPS signals. The resonant quadrifilar crank configuration provides the necessary right hand circular polarization and increases the radiation coverage in the horizontal plane.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
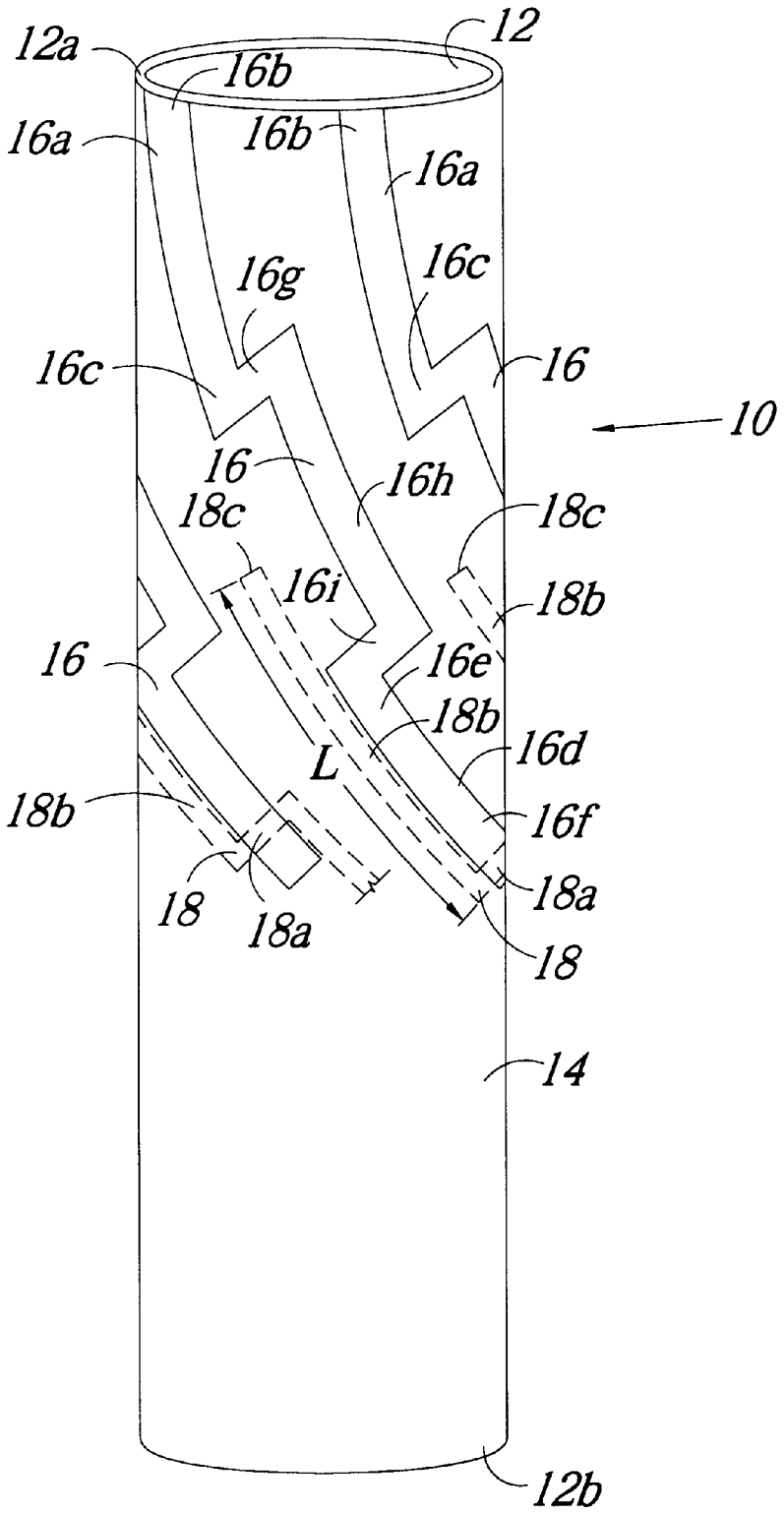
FIG. 1 is a perspective view of a quadrifilar crank slot antenna constructed according to a preferred embodiment of the present invention, with the microstrip feed lines being shown only partially for purposes of clarity.

Referring now to the drawings in more detail and initially to FIG. 1, numeral 10 generally designates a printed quarter wavelength quadrifilar crank slot antenna constructed in accordance with the present invention. The antenna 10 has a body 12 which may be constructed of a dielectric laminate having the shape of a hollow cylinder. The laminate should be nonconductive and is preferably a dielectric constructed of KAPTON material (KAPTON is a registered trademark of E. I. DuPont Nemours & Co.). Other suitable materials can be used to construct the laminate which forms the body portion 12 of the antenna 10.

The cylindrical outer surface of the body 12 is provided with a thin coating 14 which coats the outside of the antenna 10. The coating 14 is constructed of a suitable electrically conductive material such as a metal. The coating 14 provides an electrical ground for microstrip feed lines which will subsequently be described.

The antenna 10 may have a cap (not shown) which includes a conductive material that is in contact with the coating 14 when the cap is in place on the top end 12*a* of the antenna body 12.

Four helical radiating slots 16 are formed through the antenna 10 and extend through the body 12 and the coating 14. Each of the radiating slots 16 has a generally spiral or helical configuration and extends into the top end of the antenna 10. Each slot 16 has a crank shape and extends helically around approximately one-half of the circumference of the body 12. The slots 16 are spaced equidistantly apart and are parallel to one another. The slots 16 may be etched in the coating 14 using conventional techniques. The width dimension of each slot may be approximately 100 mils, although other widths are possible.

Each of the crank shaped slots 16 includes an upper leg 16*a* having a top end 16*b* at the top end 12*a* of body 12. Each of the upper legs 16*a* is helical and terminates in a bottom end 16*c*. A helical lower leg 16*d* of each slot 16 is spaced below the corresponding upper leg 16*a* such that the two legs 16*a* and 16*d* of each slot provide a discontinuous helical pattern. Each lower leg 16*d* has a top end 16*e* which is spaced below the lower end 16*c* of the corresponding upper leg. Each lower leg 16*d* has a bottom end 16*f* which is spaced well above the bottom end 12*b* of the body 12 and forms the bottom end of the slot 16.

Each slot 16 has a center portion that connects the ends 16*c* and 16*e* of the upper and lower legs. The center portion of each slot includes an upper arm 16*g* which has an inner end connected with end 16*c* of the upper leg. Each arm 16*g* extends generally laterally from the upper leg 16*a* and has an outer end that connects with the top end of a center leg 16*h*. The center leg 16*h* is helical and is offset from a linear relationship with legs 16*a* and 16*d* to form the "handle" of the crank slot 16. The center portion of each slot includes a lower arm 16*i* having its inner end connected with end 16*e* of the lower leg 16*d* and its outer end connected with the bottom end of the center leg 16*h*. The lower arm 16*i* extends laterally from leg 16*d* and is substantially parallel to the upper arm 16*g*.

A conventional hybrid electrical circuit (not shown) is connected with microstrip feed lines which are identified by numeral 18. Each of the slots 16 is provided with one of the feed lines 18. The lower end portion of each feed line 18 connects with the hybrid circuit and the lower portions of the feed lines 18 extend upwardly slightly above the bottom ends 16*f* of the corresponding slots 16. Each feed line 18 includes a relatively short transverse portion 18*a* which extends across the corresponding slot 16 at a right angle to the longitudinal axis of the slot. Each of the transverse portions 18*a* extends from the upper end of the leg of the feed line 18 which connects with the hybrid electrical circuit and extends across the lower slot leg 16*d* near its bottom end 16*f*.

Each feed line 18 also includes a longitudinal portion 18*b* which extends generally upwardly from the transverse portion. Each longitudinal portion 18*b* extends along and parallel to the lower leg 16*d* of the corresponding slot 16. The longitudinal portions 18*b* extend upwardly beyond the top ends 16*e* of the lower slot legs 16*d* and upwardly beyond the lower arms 16*i*. The longitudinal portion 18*b* of each feed line 18 terminates in an end 18*c* which is an open circuit providing the feed point. The end 18*c* is spaced from the transverse portion 18*a* of the same feed line by a distance L which defines the length of the transverse portion 18*b*. The distance L is equal to approximately ¼ λ, where λ is the wavelength of the GPS signals which the antenna is to receive. The end 18*c* is situated at a location aligned with the approximate midpoint of the center is leg 16*h*.

The arrangement of the feed lines 18 relative to the slots 16 results in balanced current flowing on both sides of each of the radiating slots 16 so that there is only minimal effect on the impedance transformation. At the same time, the resonant hexafilar structure provides the right hand circular polarization which is necessary and increases the radiation coverage in the horizontal plane.

Figure 2:
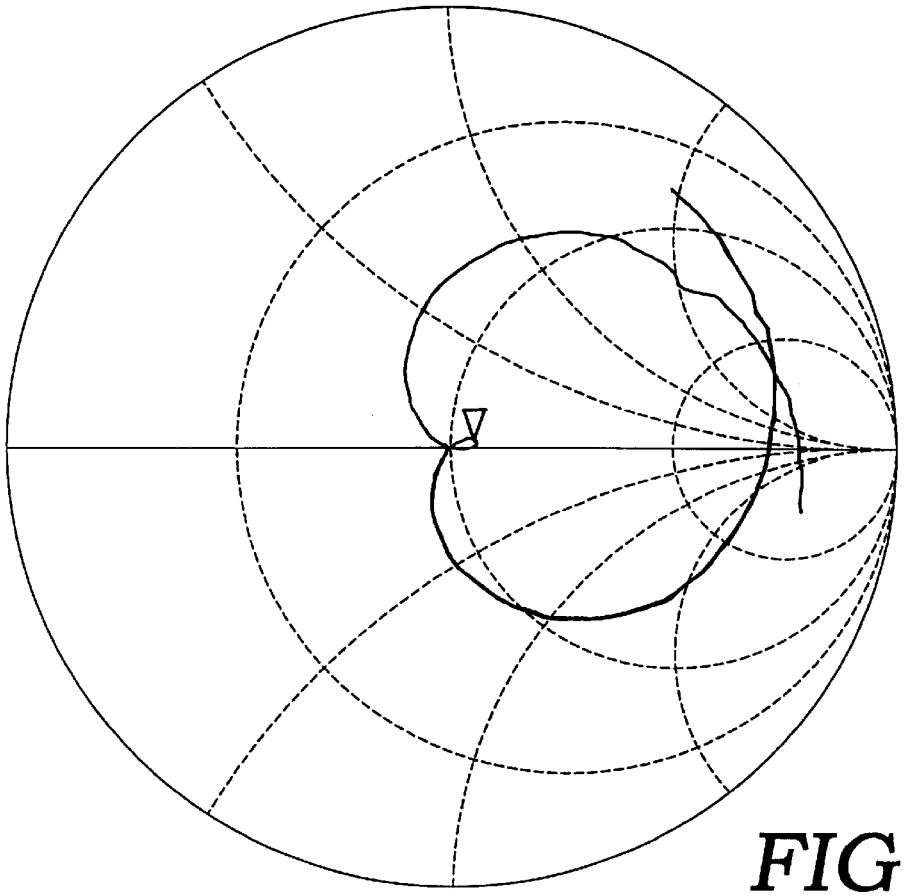
FIG. 2 is a diagrammatic view showing the measured frequency response of the input impedance of the crank slot antenna of the present invention.

FIG. 2 provides the measured frequency response of the input impedance for the antenna 10. The antenna is resonant at the GPS frequency of 1.5754 Ghz with input impedance of 56+j 3.1 Ω. The return loss at the center frequency is greater than 20 dB.

Figure 3:
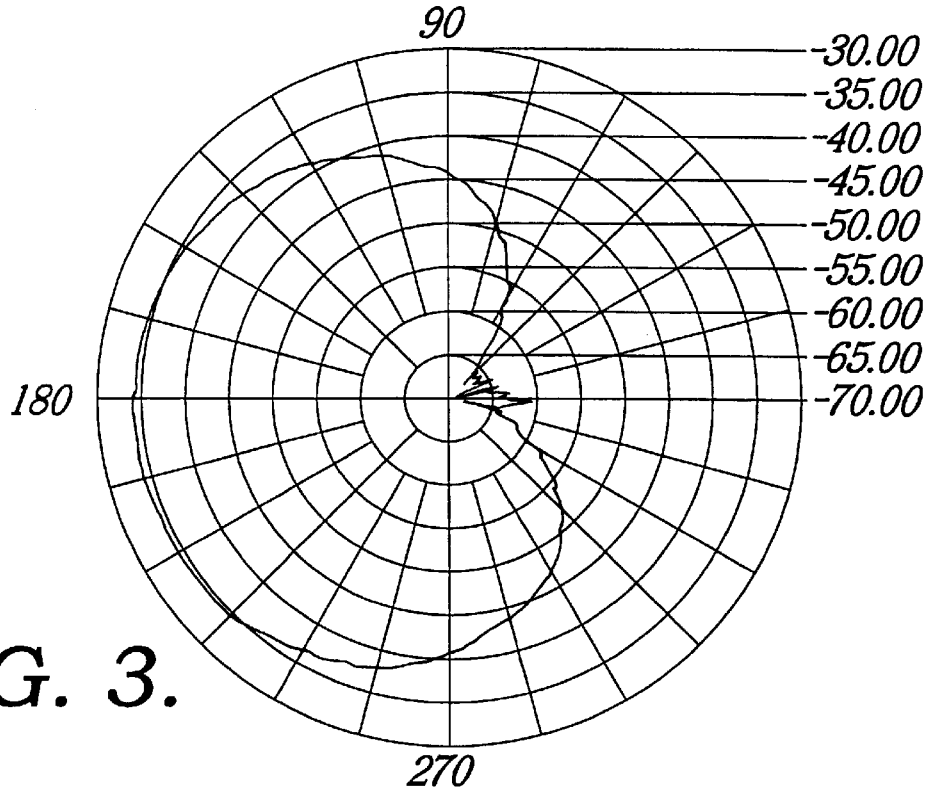
FIG. 3 is a diagrammatic view showing the radiation pattern of the crank slot antenna of the present invention.
Figure 4:
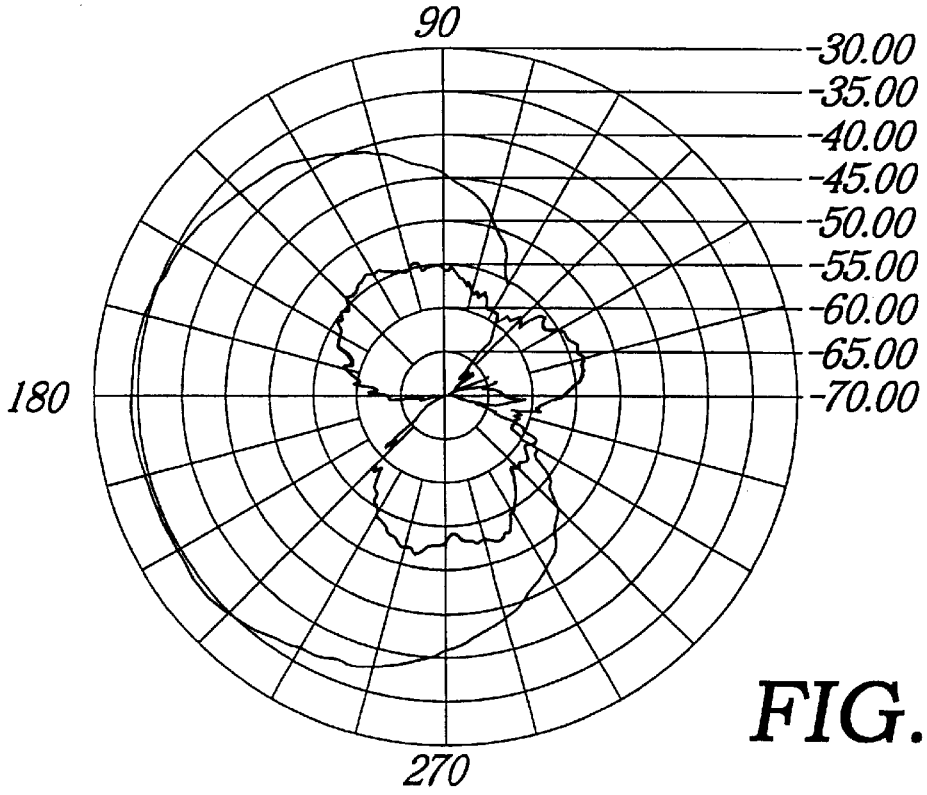
FIG. 4 is a diagrammatic view showing the isolation between the left hand and right hand circularly polarized signals of the crank slot antenna of the present invention.

The radiation pattern of the antenna 10 is depicted in FIG. 3. The half power beam width is more than 120° and there is a null at the back. FIG. 4 shows the isolation between left hand and right hand circularly polarized signals. The antenna 10 has an isolation of more than 20 dB between the front and back.

The quarter wavelength crank slot antenna 10 was verified by conducting a field test using a Garmin GPS 90™ receiver. The test was conducted under a satellite geometry with Position Dilution of Precision (PDOP) of 98 ft. The results of the test indicate that satellites 6, 10, 17, and 26 located within the axis angle of θ=±45° have calibrated signal scales of 9, 9, 8 and 9, corresponding to receiver phase noise 51 dB, 51 dB, 49 dB, and 51 dB, respectively. Satellites 13, 23, 24, and 30 located outside the axis angle of θ=±45° have calibrated signal scales of 8, 7, 8 and 5, corresponding to receiver phase noise of 49 dB, 47 dB, 49 dB and 43 dB respectively. These test results indicate a radiation pattern coverage of the antenna 10 that permits it to track satellites near the horizon at very low elevation angles.

The construction of the antenna 10 and the pattern and relationship of the slots 16 and feed lines 18 result in good input impedance matching, a good front/back ratio, and a radiation pattern coverage that is nearly hemispherical. At the same time, the known advantages of cylindrical slot antennas are achieved, including low cost manufacturing, light weight, a compact size, ease of fabrication and assembly, and simple feeding and matching techniques. The antenna 10 is particularly useful in hand held receivers which are used in a variety of applications, particularly outdoor activities.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An antenna comprising:

a nonconductive body having a generally cylindrical shape;

a conductive coating on said body;

a plurality of crank slots in said coating each having upper and lower leg portions arranged to define a discontinuous helical pattern, said upper and lower leg portions terminating in spaced apart ends;

a center portion of each slot which includes a pair of arms extending generally laterally from said ends and a center leg extending between said arms; and a microstrip feed line for each slot having a transverse portion extending across the corresponding slot and a longitudinal portion connected with the transverse portion thereof and extending generally along the slot.

2. An antenna as set forth in claim 1, wherein said body comprises a laminate.

3. An antenna as set forth in claim 1, wherein said coating provides an electrical ground for said feed lines.

4. An antenna as set forth in claim 1, wherein said longitudinal portion of each feed line terminates in an end and has a length L between the transverse portion thereof and said end thereof, said length L being approximately ¼ λ where λ is the wavelength of selected signals to be received by the antenna.

5. An antenna as set forth in claim 4, wherein said end of each feed line comprises an open circuit.

6. An antenna as set forth in claim 1, wherein each slot extends helically around approximately one half of the circumference of said body.

7. An antenna as set forth in claim 1, wherein:

said transverse portion of each feed line extends across the lower leg portion of the corresponding slot; and said longitudinal portion of each feed line extends generally along the lower leg portion of the corresponding slot and beyond said end thereof.

8. An antenna as set forth in claim 7, wherein said longitudinal portion of each feed line terminates in an end and has a length L between the transverse portion thereof and said end thereof, said length L being approximately ¼ λ where λ is the wavelength of selected signals to be received by the antenna.

9. An antenna for receiving satellite signals, comprising:

a generally cylindrical body having a hollow interior and opposite ends, said body being nonconductive;

a conductive coating on said body;

a plurality of crank slots in said coating each extending in a generally helical shape around said body through approximately one half of the circumference thereof, each slot having upper and lower leg portions, upper and lower arms extending generally laterally from the respective upper and lower leg portions, and a center leg extending between said arms; and a microstrip feed line for each slot having a transverse portion extending across the corresponding slot and a longitudinal portion connected with the transverse portion thereof and extending generally along the slot.

10. An antenna as set forth in claim 9, wherein:

said upper leg portion of each slot has a top end and a bottom end;

said lower leg portion of each slot has a top end and a bottom end; and said upper and lower leg portions of each slot are aligned, with said top end of each lower leg portion spaced below the bottom end of the corresponding upper leg portion.

11. An antenna as set forth in claim 10, wherein each top end of said upper leg portion of each slot is adjacent to one end of said body.

12. An antenna as set forth in claim 10, wherein:

each upper arm has an inner end connected with the bottom end of the corresponding upper leg portion and an outer end connected with said center leg; and each lower arm has an inner end connected with the top end of the corresponding lower leg portion and an outer end connected with said center leg.

13. An antenna as set forth in claim 12, wherein:

said transverse portion of each feed line extends across the lower leg portion of the corresponding slot; and said longitudinal portion of each feed line extends generally along the lower leg portion of the corresponding slot and beyond said end thereof.

14. An antenna as set forth in claim 13, wherein said longitudinal portion of each feed line terminates in an end and has a length L between the transverse portion thereof and said end thereof, said length L being approximately ¼ λ where λ is the wavelength of selected signals to be received by the antenna.

15. An antenna as set forth in claim 10 wherein:

said transverse portion of each feed line extends across the lower leg portion of the corresponding slot; and said longitudinal portion of each feed line extends generally along the lower leg portion of the corresponding slot and beyond said top end thereof.

16. An antenna as set forth in claim 15, wherein said longitudinal portion of each feed line terminates in an end and has a length L between the transverse portion thereof and said end thereof, said length L being approximately ¼ λ where λ is the wavelength of selected signals to be received by the antenna.

17. An antenna comprising:

a hollow body having top and bottom ends and a cylindrical outside surface, said body being nonconductive;

a conductive coating on the outside surface of said body;

a plurality of crank slots in said coating each extending in a generally helical pattern on said body;

an upper leg portion of each slot having a top end adjacent said top end of said body and a bottom end;

a lower leg portion of each slot having a top end spaced below said bottom end of the upper leg portion and a bottom end spaced from the bottom end of said body;

an upper arm portion of each slot extending generally laterally from the bottom end of said upper leg portion;

a lower arm portion of each slot extending generally laterally from the top end of said lower leg portion;

a center leg portion of each slot extending between said upper and lower arm portions; and a microstrip feed line for each slot having a transverse portion extending across the corresponding slot and a longitudinal portion connected with the transverse portion thereof and extending generally along the slot.

18. An antenna as set forth in claim 17, wherein:

said transverse portion of each feed line extends across the lower leg portion of the corresponding slot; and said longitudinal portion of each feed line extends generally along the lower leg portion of the corresponding slot and beyond said top end thereof.

19. An antenna as set forth in claim 18, wherein said longitudinal portion of each feed line terminates in an end and has a length L between the transverse portion thereof and said end thereof, said length L being approximately ¼ λ where λ is the wavelength of selected signals to be received by the antenna.

20. An antenna as set forth in claim 18, wherein the longitudinal portion of each feed line terminates in an open circuit.

* * * * *